US008153565B2

(12) United States Patent
Tipton et al.

(10) Patent No.: US 8,153,565 B2
(45) Date of Patent: Apr. 10, 2012

(54) LUBRICANT COMPOSITION FOR A FINAL DRIVE AXLE

(75) Inventors: Craig D. Tipton, Perry, OH (US); Thomas A. Tagliamonte, Mentor, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 62 days.

(21) Appl. No.: 12/096,798

(22) PCT Filed: Dec. 15, 2006

(86) PCT No.: PCT/US2006/062172

§ 371 (c)(1), (2), (4) Date: Jul. 21, 2009

(87) PCT Pub. No.: WO2007/111741

PCT Pub. Date: Oct. 4, 2007

(65) Prior Publication Data

US 2009/0298727 A1 Dec. 3, 2009

Related U.S. Application Data

(60) Provisional application No. 60/750,721, filed on Dec. 15, 2005.

(51) Int. Cl.
*C10L 1/22* (2006.01)
*C10M 139/00* (2006.01)

(52) U.S. Cl. ..... 508/192; 508/196

(58) Field of Classification Search ..... 508/192, 508/196

See application file for complete search history.

(56) References Cited

U.S. PATENT DOCUMENTS

| | | | | |
|---|---|---|---|---|
| 3,254,025 | A | 5/1966 | Le Suer | |
| 4,136,043 | A | 1/1979 | Davis | |
| 5,674,820 | A | 10/1997 | Manka et al. | |
| 6,124,249 | A * | 9/2000 | Seebauer et al. | 508/469 |
| 6,232,275 | B1 | 5/2001 | Ichihashi et al. | |
| 6,528,458 | B1 * | 3/2003 | Tagliamonte et al. | 508/185 |
| 2002/0151441 | A1 * | 10/2002 | Srinivasan et al. | 508/188 |
| 2003/0130141 | A1 * | 7/2003 | Nalesnik | 508/277 |
| 2003/0144157 | A1 | 7/2003 | Nakamura | |
| 2004/0167041 | A1 * | 8/2004 | Arimoto | 508/272 |

FOREIGN PATENT DOCUMENTS

DE 19954658 A1 5/2005

OTHER PUBLICATIONS

PCT Search Report of corresponding International Application No. PCT/US2006/062172 mailed Feb. 14, 2008.

* cited by examiner

*Primary Examiner* — Walter D Griffin
*Assistant Examiner* — Francis C Campanell
(74) *Attorney, Agent, or Firm* — Christopher D. Hiker; David M. Shold

(57) ABSTRACT

A lubricant composition for a final drive axle oil comprising an oil of lubricating viscosity, one or more dispersants and one or more phosphorus compounds wherein the kinematic viscosity of the lubricant composition at 100° C. is greater than 10 mm2/s and wherein the amount by weight of the dispersant is greater than the amount by weight of the phosphorus compounds and any sulfur compounds which may optionally be present.

14 Claims, No Drawings

LUBRICANT COMPOSITION FOR A FINAL DRIVE AXLE

This application claims priority back to U.S. Application No. 60/750,721 filed Dec. 15, 2005.

BACKGROUND OF THE INVENTION

The present invention relates to a lubricant additive formulation containing no active sulfur, a phosphorus containing compound, multifunctional dispersants in a high viscosity lubricating composition for use in a final drive gearing system.

The wheels of an on-highway and/or off-highway vehicle can be driven by a final drive axle unit that splits the torque received from the input shaft between the wheels by means of a gear set inside a gear housing of the final drive unit. The gears in the final drive can be of the type including but not limited to spiral bevel, hypoid, spur and helical or combination thereof. In one example the gear arrangement can be a differential gear arrangement. These gears require lubrication.

The primary function of the gear lubricant is to provide adequate protection against wear, scuffing and micropitting and provide for seal, rubber and composite material capability, while providing acceptable oxidation stability and cleanliness during the service life of the gear equipment. Therefore, there is need for a gear lubricating composition capable of operating at a higher power throughput and operating temperatures while providing seal, rubber and composite material capability.

U.S. Pat. No. 5,942,470 discloses a gear oil composition containing (i) an oil-soluble sulphur-containing extreme pressure agent or antiwear agent, (ii) at least one oil soluble amine salt of a partial ester of an acid of phosphorus, (iii) a succinimide dispersant with a N—H bond; and (iv) at least one of a nitrogen-containing ashless dispersant, an amine salt of a carboxylic acid and a trihydrocarbyl ester of a pentavalent acid of phosphorus. In one embodiment, the gear oil composition is essentially devoid of any metal-containing additive component.

EP 1191090 discloses a gear oil composition for use in a final drive axle unit containing (i) mineral oil, (ii) vinyl aromatic-diene copolymers, olefin copolymers and mixtures thereof, (iii) at least one polyalphaolefin having a kinematic viscosity of at least 40 $mm^2/s$ at 100° C., and (iv) a gear additive package.

The present invention solves the problem of providing a higher viscosity lubricating composition, especially for use in a final drive axle while providing rubber, seal and composite material capability while lubricating gears without the presence of active sulfur in the formulation.

SUMMARY OF THE INVENTION

The present invention provides for a lubricant composition suitable for use in a final drive gearing system, comprising:

(a) an oil of lubricating viscosity;

(b) one or more dispersants; and (c) one or more phosphorus compounds;

wherein the kinematic viscosity of the lubricant composition at 100° C. is greater than 10 $mm^2/s$;

wherein the amount by weight of the dispersant is greater than the amount by weight of the phosphorus compounds and any sulfur compounds, which may be optionally present.

The present invention further provides a method for lubricating a final drive gearing system, comprising:

(a) supplying to said gears (i) an oil of lubricating viscosity;

(ii) one or more dispersants; and (iii) one or more phosphorus compounds;

wherein the kinematic viscosity of the lubricant composition at 100° C. is greater than 10 $mm^2/s$; and wherein the amount by weight of the dispersant is greater than the amount by weight of the phosphorus compounds and any sulfur compounds which may be optionally present.

DETAILED DESCRIPTION OF THE INVENTION

Various preferred features and embodiments will be described below by way of non-limiting illustration.

The lubricant composition of the present invention useful for a final drive axle comprises an oil of lubricating viscosity, one or more detergents and a phosphorus compound.

Oil of L

One component of the present invention is an oil of lubricating viscosity. In one embodiment the lubricating composition includes natural or synthetic oils of lubricating viscosity, oil derived from hydrocracking, hydrogenation, hydrofinishing, unrefined, refined and re-refined oils or mixtures thereof.

Oils of lubricating viscosity may also be defined as specified in the American Petroleum Institute (API) Base Oil Interchangeability Guidelines. In several embodiments the oil of lubricating viscosity comprises an API Group I, II, III, IV, V, VI or mixtures thereof, or an API Group I, II, III or mixtures thereof. If the oil of lubricating viscosity is an API Group II, III, IV, V or VI oil there may be up to a maximum of 40 wt % or up to a maximum of 5 wt % of the lubricating oil being an API Group I oil.

The oil of lubricating viscosity may be a natural oil, synthetic oil or mixture thereof. The natural oils that are useful include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils derived from coal or shale are also useful. Synthetic lubricating oils include hydrocarbon oils such as polymerized and interpolymerized olefins (e.g., polybutylenes, polypropylenes, propylene isobutylene copolymers, etc.); poly(1-hexenes), poly-(1-octenes), poly(1-decenes), etc. and mixtures thereof; alkylbenzenes (e.g., dodecylbenzenes, tetradecylbenzenes, dinonylbenzenes, di-(2-ethylhexyl)benzenes, etc.); polyphenyls (e.g., biphenyls, terphenyls, alkylated polyphenyls, etc.); alkylated diphenyl ethers and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed C3-8 fatty acid esters, or the carboxylic acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from C5 to C22 monocarboxylic acids and polyols and polyol ethers such as neopentyl glycol, trimethylol propane, pentaerythritol, dipentaerythritol, tripentaerythritol, etc.

The oil of lubricating viscosity can be a poly-alpha-olefin (PAO). Typically, the PAOs are derived from monomers having from 4 to 30, or from 4 to 20, or from 6 to 16 carbon atoms. Examples of useful PAOs include those derived from octene, decene, mixtures thereof, and the like. These PAOs generally may have a viscosity from 2 to 20, or from 3 to 15, or from 4 to 12, or 5 to 10 $mm^2/s$ (cSt), at 100° C. Examples of useful PAOs include 10 $mm^2/s$ (cSt) at 100° C. poly-alpha-olefins, 12 $mm^2/s$ (cSt) at 100° C. poly-alpha-olefins, and mixtures thereof. Mixtures of mineral oil with one or more of the foregoing PAOs may be used.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Additionally, oils prepared by a Fischer-Tropsch gas to liquid synthetic procedure are known and can be used.

The oil of lubricating viscosity of the present invention can be present in an amount greater than about 50 percent, or greater than about 60 percent, or greater than about 70 percent, or greater than about 80, or greater than about 90 percent by weight of the lubricant composition.

Lubricant Composition

The lubricating oil composition can be comprised of one or more oils of lubricating viscosity which are generally present in a major amount (i.e. an amount greater than about 50 percent by weight), along with the required additives. In certain embodiments, the lubricating composition that is the combination of oil with the additives may have a kinematic viscosity of greater than 10 $mm^2/s$ or 12 $mm^2/s$ or 15 $mm^2/s$ or 20 $mm^2/s$ at 100° C.

The Dispersant

The dispersant of the invention is well known and can include a succinimide dispersant (for example N-substituted long chain alkenyl succinimides), a Mannich dispersant, an ester-containing dispersant, a condensation product of a fatty hydrocarbyl monocarboxylic acylating agent with an amine or ammonia, an alkyl amino phenol dispersant, a hydrocarbyl-amine dispersant, a polyether dispersant, a polyetheramine dispersant, a viscosity modifier containing dispersant functionality (for example polymeric viscosity index modifiers (VMs) containing dispersant functionality), or mixtures thereof.

In several embodiments the N-substituted long chain alkenyl succinimides contain an average of at least 8, or 30, or 35 up to 350, or to 200, or to 100 carbon atoms. In one embodiment, the long chain alkenyl group is derived from a polyalkene characterised by an $\overline{M}_n$ (number average molecular weight) of at least 500. Generally, the polyalkene is characterised by an $\overline{M}_n$ of 500, or 700, or 800, or even 900 up to 5000, or to 2500, or to 2000, or even to 1500 or 1200. In one embodiment the long chain alkenyl group is derived form polyolefins. The polyolefins may be derived from monomers including monoolefins having 2 to 10 carbon atoms such as ethylene, propylene, 1-butene, isobutylene, and 1-decene. An especially useful monoolefin source is a $C_4$ refinery stream having a 35 to 75 weight percent butene content and a 30 to 60 weight percent isobutene content. Useful polyolefins include polyisobutylenes having a number average molecular weight of 140 to 5000, in another instance of 400 to 2500, and in a further instance of 140 or 500 to 1500. The polyisobutylene may have a vinylidene double bond content of 5 to 69%, in a second instance of 50 to 69%, and in a third instance of 50 to 95%.

Succinimide dispersants and their methods of preparation are more fully described in U.S. Pat. Nos. 4,234,435 and 3,172,892.

Another class of dispersant is ester-containing dispersants, which are typically high molecular weight esters. These materials are described in more detail in U.S. Pat. No. 3,381,022.

Mannich dispersants are the reaction product of a hydrocarbyl-substituted phenol, an aldehyde, and an amine or ammonia. The hydrocarbyl substituent of the hydrocarbyl-substituted phenol may have 10 to 400 carbon atoms, in another instance 30 to 180 carbon atoms, and in a further instance 10 or 40 to 110 carbon atoms. This hydrocarbyl substituent may be derived from an olefin or a polyolefin. Useful olefins include alpha-olefins, such as 1-decene, which are commercially available.

Hydrocarbyl-amine dispersants are hydrocarbyl-substituted amines. The hydrocarbyl-substituted amine may be formed by heating a mixture of a chlorinated olefin or polyolefin such as a chlorinated polyisobutylene with an amine such as ethylenediamine in the presence of a base such as sodium carbonate as described in U.S. Pat. No. 5,407,453.

Polyether dispersants include polyetheramines, polyether amides, polyether carbamates, and polyether alcohols. Polyetheramines and their methods of preparation are described in greater detail in U.S. Pat. No. 6,458,172, columns 4 and 5.

In another embodiment, the dispersant may be a post-treated dispersant. Post-treated dispersants may be obtained by reacting a carboxylic, amine or Mannich dispersant with reagents such as urea, thiourea, carbon disulfide, aldehydes, ketones, carboxylic acids, hydrocarbon-substituted succinic anhydrides, nitrites, epoxides, boron compounds such as boric acid (to give "borated dispersants"), phosphorus compounds such as phosphorus acids or anhydrides, or 2,5-dimercaptothiadiazole (DMTD). These are described in the following U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422

In one embodiment, the amount by weight of the dispersant is greater than the amount by weight of the phosphorus compounds and any sulfur compounds, which may be optionally present.

For the purposes of determining if the weight of the dispersant is greater than the amount by weight of the phosphorus compounds and any sulfur compounds, the components will be considered on an oil-free basis. Further any dispersant which is post-treated or salted or complexed with a phosphorus compound or sulfur compound with be treated as individual constituent components, i.e. the dispersant portion of the molecule will be summed with the dispersants and the phosphorus or sulfur post-treating, salting or complexing agents will be summed with the phosphorus and sulfur compounds.

The dispersant of the present invention can be present in an amount from about 0.5 to about 8.0 percent by weight, or about 1.0 to about 5.0 percent by weight, or about 2 to about 3 percent by weight of the lubricant composition.

Phosphorus Compound

Another component of the present invention is a phosphorus compound, which can include a phosphorus acid, a phosphorus acid salt, a phosphorus ester, or mixtures thereof. The phosphorus acid or ester can be of the formula $(R^1X)(R^2X)P(X)_nX_mR^3$ or a salt thereof, where each X is independently an oxygen atom or a sulfur atom, n is 0 or 1, m is 0 or 1, m+n is 1 or 2, and $R^1$, $R^2$, and $R^3$ are hydrogen or hydrocarbyl groups, and preferably at least one of $R^1$, $R^2$, or $R^3$ is hydrogen. This component thus includes phosphorous and phosphoric acids, thiophosphorous and thiophosphoric acids, as well as phosphite esters, phosphate esters, thiophosphite esters, and thiophosphate esters. It is noted that certain of these materials can exist in tautomeric forms, and that all such tautomers are intended to be encompassed by the above formula and included within the present invention. For example, phosphorous acid and certain phosphite esters can be written in at least two ways:

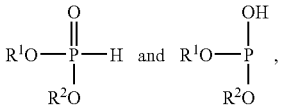

differing merely by the placement of the hydrogen. Each of these structures is intended to be encompassed by the present invention.

The phosphorus-containing acids can be at least one phosphate, phosphonate, phosphinate or phosphine oxide. These pentavalent phosphorus derivatives can be represented by the formula:

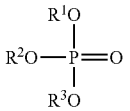

wherein $R^1$, $R^2$ and $R^3$ are as defined above. The phosphorus-containing acid can be at least one phosphite, phosphonite, phosphinite or phosphine. These trivalent phosphorus derivatives can be represented by the formula:

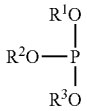

wherein $R^1$, $R^2$ and $R^3$ are defined as above. Generally, the total number of carbon atoms in $R^1$, $R^2$ and $R^3$ is at least 8, and in one embodiment at least 12, and in one embodiment at least 16. Examples of useful $R^1$, $R^2$ and $R^3$ groups include hydrogen, t-butyl, isobutyl, amyl, isooctyl, decyl, dodecyl, oleyl, $C_{18}$ alkyl, eicosyl, 2-pentenyl, dodecenyl, phenyl, naphthyl, alkylphenyl, alkylnaphthyl, phenylalkyl, naphthylalkyl, alkylphenylalkyl, and alkylnaphthylalkyl groups. In another embodiment, $R^1$, $R^2$ and $R^3$ groups are phenyl.

In one embodiment, at least two of the X atoms in the above structure are oxygen, so that the structure will be $(R^1O)(R^2O)P(X)_nX_mR^3$, and in another embodiment $(R^1O)(R^2O)P(X)_nX_mH$. This structure can correspond, for example, to phosphoric acid when $R^1$, $R^2$, and $R^3$ are hydrogen. Phosphoric acid exists as the acid itself, $H_3PO_4$ and other forms equivalent thereto such as pyrophosphoric acid and anhydrides of phosphoric acid, including 85% phosphoric acid (aqueous), which is the commonly available commercial grade material. The formula can also correspond to a mono- or dialkyl hydrogen phosphite such as dibutyl hydrogen phosphite (a phosphite ester) when one or both of $R^1$ and $R^2$ are alkyl, respectively and $R^3$ is hydrogen, or a trialkyl phosphite ester when each of $R^1$, $R^2$, and $R^3$ is alkyl; in each case where n is zero, m is 1, and the remaining X is O. The structure will correspond to phosphoric acid or a related material when n and m are each 1; for example, it can be a phosphate ester such as a mono-, di- or trialkyl monothiophosphate when one of the X atoms is sulfur and one, two, or three of $R_6$, $R_7$, and $R_8$ are alkyl, respectively.

Phosphoric acid and phosphorus acid are well-known items of commerce. Thiophosphoric acids and thiophosphorous acids are likewise well known and are prepared by reaction of phosphorus compounds with elemental sulfur or other sulfur sources. Processes for preparing thiophosphorus acids are reported in detail in *Organic Phosphorus Compounds*, Vol. 5, pages 110-111, G. M. Kosolapoff et al., 1973.

Salts of the above phosphorus acids are well known. Salts include ammonium and amine salts as well as metal salts. Zinc salts, such as zinc dialkyldithiophosphates, are useful in certain applications. In one embodiment of the present invention, the zinc content is less than 0.05 percent by weight, or less than 0.02 percent by weight or less than 0.01 percent by weight.

The phosphorus content of the present invention can be an amount from about 0.001 to about 0.2 percent by weight, or about 0.005 percent to about 0.15 percent by weight, or about 0.01 to about 0.12 percent by weight of the lubricant composition. In one embodiment, the amount of the phosphorus compounds needed to impart said level of phosphorus content to the lubricant composition may be about 0.01 to about 2 percent by weight, or about 0.1 to about 1.5 percent by weight of the lubricant composition.

The Dimercaptothiadiazole

The lubricant composition of the present invention may further comprise a dimercaptothiadiazole. In one embodiment the corrosion inhibitor is a dimercaptothiadiazole or dimercaptothiadiazole derivative. Examples of a suitable thiadiazole include 2,5-dimercapto-1,3-4-thiadiazole or a hydrocarbyl-substituted 2,5-dimercapto-1,3,4-thiadiazole or a hydrocarbylthio substituted 2,5-dimercapto-1,3,4-thiadiazole. In several embodiments the number of carbon atoms on the hydrocarbyl-substituent group includes 1 to 30, 2 to 25, 4 to 20, or 6 to 16. Examples of suitable 2,5-bis(alkyl-dithio)-1,3,4-thiadiazoles include 2,5-bis(tert-octyldithio)-1,3,4-thiadiazole, 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thiadiazole, 2,5-bis(tert-pentadecyldithio)-1,3,4-thiadiazole, 2,5-bis(tert-hexadecyldithio)-1,3,4-thiadiazole, 2,5-bis(tert-heptadecyldithio)-1,3,4-thiadiazole, 2,5-bis(tert-octadecyldithio)-1,3,4-thiadiazole, 2,5-bis(tert-nonadecyldithio)-1,3,4-thiadiazole or 2,5-bis(tert-eicosyldithio)-1,3,4-thiadiazole. Moreover dimercaptothiadiazole or its derivatives may be provided by a combination an of oil soluble dispersant with dimercaptothiadiazole. In another embodiment, the corrosion inhibitor is a heptylphenol coupled with 2,5-dimercapto-1,3,4-thiadiazole using formaldehyde (the thiadiazole is generated in situ); 20% oil, 17.75% S, 5.5% N.

In one embodiment, the dimercaptothiadiazole of the present invention can be present in an amount from about 0.05 to about 8.0 percent by weight, or about 0.1 to about 4.0 percent by weight, or about 0.15 to about 2.0 percent by weight of the lubricant composition.

Friction Modifier

The lubricant composition may further comprise a friction modifier. Friction modifiers are well known to those skilled in the art. A useful list of friction modifiers is included in U.S. Pat. No. 4,792,410. U.S. Pat. No. 5,110,488 discloses metal salts of fatty acids and especially zinc salts, useful as friction modifiers. A list of friction modifiers includes: borated fatty epoxides, fatty epoxides, borated alkoxylated fatty amines, alkoxylated fatty amines, fatty amines, borated glycerol esters, polyol or glycerol esters, metal salts of fatty acids, fatty acid amides, fatty imidazolines, condensation products of carboxylic acids and polyalkylene-polyamines, sulfurized olefins, amine salts of partial esters of phosphoric acids, dialkyl phosphites, metal salts of alkyl salicylates, esters of long chain alkyl phosphonates, long chain amino ethers and alkyoxylated versions thereof, long chain alkyoxylated alcohol, organo molybdenum compounds, or mixtures thereof.

Representatives of each of these types of friction modifiers are known and are commercially available. For instance, borated fatty epoxides are known from Canadian Patent No. 1,188,704. These oil-soluble boron-containing compositions are prepared by reacting, at a temperature from 80° C. to 250° C., boric acid or boron trioxide with at least one fatty epoxide having the formula:

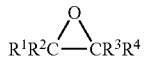

wherein each of $R^1$, $R^2$, $R^3$ and $R^4$ is hydrogen or an aliphatic radical, or any two thereof together with the epoxy carbon atom or atoms to which they are attached, form a cyclic radical. The fatty epoxide preferably contains at least 8 carbon atoms.

The borated fatty epoxides can be characterized by the method for their preparation which involves the reaction of two materials. Reagent A can be boron trioxide or any of the various forms of boric acid including metaboric acid ($HBO_2$), orthoboric acid ($H_3BO_3$) and tetraboric acid ($H_2B_40_7$). Boric acid, and especially orthoboric acid, is preferred. Reagent B can be at least one fatty epoxide having the above formula. In the formula, each of the R groups is most often hydrogen or an aliphatic radical with at least one being a hydrocarbyl or aliphatic radical containing at least 6 carbon atoms. The molar ratio of reagent A to reagent B is generally 1:0.25 to 1:4. Ratios of 1:1 to 1:3 are preferred, with about 1:2 being an especially preferred ratio. The borated fatty epoxides can be prepared by merely blending the two reagents and heating them at temperature of 80° to 250° C., preferably 100° to 200° C., for a period of time sufficient for reaction to take place. If desired, the reaction may be effected in the presence of a substantially inert, normally liquid organic diluent. During the reaction, water is evolved and may be removed by distillation.

Non-borated fatty epoxides, corresponding to "Reagent B" above, are also useful as friction modifiers.

Borated amines are generally known from U.S. Pat. No. 4,622,158. Borated amine friction modifiers (including borated alkoxylated fatty amines) are conveniently prepared by the reaction of a boron compounds, as described above, with the corresponding amines. The amine can be a simple fatty amine or hydroxy containing tertiary amines. The borated amines can be prepared by adding the boron reactant, as described above, to an amine reactant and heating the resulting mixture at a 50° to 300° C., preferably 100° C. to 250° C. or 150° C. to 230° C., with stirring. The reaction is continued until by-product water ceases to evolve from the reaction mixture indicating completion of the reaction.

Among the amines useful in preparing the borated amines are commercial alkoxylated fatty amines known by the trademark "ETHOMEEN" and available from Akzo Nobel. Representative examples of these ETHOMEEN™ materials is ETHOMEEN™ C/12 (bis[2-hydroxyethyl]-coco-amine); ETHOMEEN™ C/20 (polyoxyethylene[10]cocoamine); ETHOMEEN™ S/12 (bis[2-hydroxyethyl]soyamine); ETHOMEEN™ T/12 (bis[2-hydroxyethyl]-tallow-amine); ETHOMEEN™ T/15 (polyoxyethylene-[5]tallowamine); ETHOMEEN™ 0/12 (bis[2-hydroxyethyl]oleyl-amine); ETHOMEEN™ 18/12 (bis[2-hydroxyethyl]octadecylamine); and ETHOMEEN™ 18/25 (polyoxyethyl-ene[15] octadecylamine). Fatty amines and ethoxylated fatty amines are also described in U.S. Pat. No. 4,741,848.

The alkoxylated fatty amines and fatty amines themselves (such as oleylamine) can be generally useful as friction modifiers in this invention. Such amines are commercially available.

In one embodiment the friction modifier can be a condensation product of a fatty acid and an amine or mixtures thereof. The amine may be a polyamine or a monoamine. When the condensation of a fatty acid and an amine is a monoamine the product may be an amide-ester.

Examples of monoamines include methylamine, ethylamine, propylamine, butylamine, octylamine, and dodecylamine. Examples of secondary monoamines include dimethylamine, diethylamine, dipropylamine, dibutylamine, methylbutylamine, and ethylhexylamine. The monoamine may also be an aminoalcohol containing 1 to 6 or 1 to 4 hydroxyl groups. Examples of aminoalcohols include tri-(hydroxypropyl)amine, tris-(hydroxymethyl)amino methane, 2-amino-2-methyl-1,3-propanediol, N,N,N',N'-tetrakis (2-hydroxypropyl)ethylenediamine, and N,N,N',N'-tetrakis (2-hydroxyethyl)ethylenediamine.

The polyamines may be acyclic or cyclic. In one embodiment, the polyamines may be alkylenepolyamines selected from the group consisting of ethylenepolyamines, propylenepolyamines, butylenepolyamines and mixtures thereof.

Examples of propylenepolyamines can include propylenediamine and dipropylenetriamine.

In one embodiment, the ethylenepolyamines are selected from the group consisting of ethylenediamine, diethylenetriamine, triethylenetetramine, tetraethylenepentamine, pentaethylenehexamine, N-(2-aminoethyl)-N'-[2-[(2-aminoethyl) amino]ethyl]-1,2-ethanediamine, polyamine still bottoms and mixtures thereof.

In one embodiment, the fatty acid can be condensed with a polyamine. Typically the condensation product may be at least one compound selected from hydrocarbyl amides, hydrocarbyl imidazolines and mixtures thereof. In one embodiment, the condensation products are hydrocarbyl imidazolines. In another embodiment, the condensation products are hydrocarbyl amides. In yet another embodiment, the condensation products are mixtures of hydrocarbyl imidazolines and hydrocarbyl amides. In one embodiment, the condensation product is mixtures of hydrocarbyl imidazolines and hydrocarbyl amides.

The fatty acid may be derived from a hydrocarbyl carboxylic acid. The hydrocarbyl group of the fatty acid typically contains 8 or more, 10 or more, 13 or more or 14 or more carbon atoms (including the carbon of the carboxy group). The number of carbon atoms present on the fatty acid typically ranges from 8 to 30, 12 to 24 or 16 to 18. Other suitable carboxylic acids can include the polycarboxylic acids or carboxylic acids or anhydrides having from 2 to 4 carbonyl groups, for instance 2. The polycarboxylic acids may include succinic acids and anhydrides and Diels-Alder reaction products of unsaturated monocarboxylic acids with unsaturated carboxylic acids (such as acrylic, methacrylic, maleic, fumaric, crotonic and itaconic acids). In several embodiments, the fatty carboxylic acids are fatty monocarboxylic acids containing 8 to 30, 10 to 26 or 12 to 24 carbon atoms.

Examples of suitable fatty acids can include caprylic acid, capric acid, lauric acid, myristic acid, palmitic acid, isostearic acid, stearic acid, eicosic acid and, tall oil acids.

Both borated and unborated fatty acid esters of glycerol can be used as friction modifiers. The borated fatty acid esters of glycerol are prepared by borating a fatty acid ester of glycerol with boric acid with removal of the water of reaction. Commonly, there is sufficient boron present such that each boron will react with from 1.5 to 2.5 hydroxyl groups present in the reaction mixture. The reaction may be carried out at a temperature in the range of 60° C. to 135° C., in the absence or presence of any suitable organic solvent such as methanol, benzene, xylenes, toluene, or oil.

Fatty acid esters of glycerol themselves can be prepared by a variety of methods well known in the art. Many of these esters, such as glycerol monooleate and glycerol tallowate, are manufactured on a commercial scale. The esters useful are oil-soluble and are commonly prepared from C8 to C22 fatty acids or mixtures thereof such as are found in natural products and as are described in greater detail below. Fatty acid monoesters of glycerol are commonly use, although, mixtures of mono- and diesters may be used. For example, commercial glycerol monooleate may contain a mixture of 45% to 55% by weight monoester and 55% to 45% diester.

Fatty acids can be used in preparing the above glycerol esters; they can also be used in preparing their metal salts, amides, and imidazolines, any of which can also be used as friction modifiers. Commonly used fatty acids are those containing 6 to 24 carbon atoms, preferably 8 to 18. The acids can be branched or straight-chain, saturated or unsaturated. Suitable acids include 2-ethylhexanoic, decanoic, oleic, stearic, isostearic, palmitic, myristic, palmitoleic, linoleic, lauric, and linolenic acids, and the acids from the natural products tallow, palm oil, olive oil, peanut oil, corn oil, and Neat's foot oil. A particularly preferred acid is oleic acid. Commonly used metal salts include zinc and calcium salts. Examples are overbased calcium salts and basic oleic acid-zinc salt complexes which can be represented by the general formula $Zn_4Oleate_6O$. Commonly used amides are those prepared by condensation with ammonia or with primary or secondary amines such as diethylamine and diethanolamine. Fatty imidazolines are the cyclic condensation product of an acid with a diamine or polyamine such as a polyethylenepolyamine. The imidazolines are generally represented by the structure

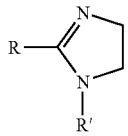

where R is an alkyl group and R' is hydrogen or a hydrocarbyl group or a substituted hydrocarbyl group, which may include —$(CH_2CH_2NH)_n$— as a part thereof. In one embodiment the friction modifier is the condensation product of a C8 to C24 fatty acid with a polyalkylene polyamine, and in particular, the product of isostearic acid with tetraethylenepentamine. The condensation products of carboxylic acids and polyalkyleneamines may generally be imidazolines or amides.

Sulfurized olefins are well known commercial materials used as friction modifiers. A particularly commonly used sulfurized olefin is one which is prepared in accordance with the detailed teachings of U.S. Pat. Nos. 4,957,651 and 4,959,168. Described therein is a cosulfurized mixture of 2 or more reactants selected from the group consisting of (1) at least one fatty acid ester of a polyhydric alcohol, (2) at least one fatty acid, (3) at least one olefin, and (4) at least one fatty acid ester of a monohydric alcohol.

Reactant (3), the olefin component, comprises at least one olefin. This olefin is typically an aliphatic olefin, which usually will contain 4 to 40 carbon atoms, preferably from 8 to 36 carbon atoms. Terminal olefins, or alpha-olefins, are commonly used, especially those having from 12 to 20 carbon atoms. Mixtures of these olefins are commercially available, and such mixtures are contemplated for use in this invention.

The cosulfurized mixture of two or more of the reactants, is prepared by reacting the mixture of appropriate reactants with a source of sulfur. The mixture to be sulfurized can contain 10 to 90 parts of Reactant (1), or 0.1 15 parts by weight of Reactant (2); or 10 to 90 parts, often 15 to 60 parts, more often 25 to 35 parts by weight of Reactant (3), or 10 to 90 parts by weight of reactant (4). The mixture includes Reactant (3) and at least one other member of the group of reactants identified as reactants (1), (2) and (4). The sulfurization reaction generally is effected at an elevated temperature with agitation and optionally in an inert atmosphere and in the presence of an inert solvent. The sulfurizing agents useful in the process include elemental sulfur, which is preferred, hydrogen sulfide, sulfur halide plus sodium sulfide, and a mixture of hydrogen sulfide and sulfur or sulfur dioxide. Typically often 0.5 to 3 moles of sulfur are employed per mole of olefinic bonds.

Another type of friction modifier for use in the present invention can be an amine salts of partial esters of phosphoric acids. Useful amines in this regard are tertiary-aliphatic primary amines, sold under the tradename Primene™.

Another friction for use in the present invention can be a dialkyl phosphite. Dialkyl phosphite's are generally of the formula $(RO)_2PHO$. The dialkyl phosphite, as shown in the preceding formula, is typically present with a minor amount of monoalkyl phosphite of the formula (RO)(HO)PHO. In these structures, the term "R" is conventionally referred to as an alkyl group. It is, of course, possible that the alkyl is actually alkenyl and thus the terms "alkyl" and "alkylated," as used herein, will embrace other than saturated alkyl groups within the phosphite. The phosphite should have sufficient hydrocarbyl groups to render the phosphite substantially oleophilic. Typically the hydrocarbyl groups are substantially unbranched. Many suitable phosphites are available commercially and may be synthesized as described in U.S. Pat. No. 4,752,416. It is common that the phosphite contain 8 to 24 carbon atoms in each of R groups. Typically, the dialkyl phosphite contains 12 to 22 carbon atoms in each of the dialkyl radicals, most commonly 16 to 20 carbon atoms. In one embodiment the dialkyl phosphite can be formed from oleyl groups, thus having 18 carbon atoms in each fatty radical.

Metal salts of alkyl salicylates include calcium and other salts of long chain (e.g. C12 to C16) alkyl-substituted salicylic acids.

The amides may be those prepared by condensation with ammonia or with primary or secondary amines such as diethylamine and diethanolamine. Fatty imidazolines may include the cyclic condensation product of an acid with a diamine or polyamine such as a polyethylenepolyamine. The imidazolines may be represented by the structure

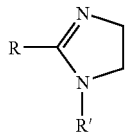

where R is an alkyl group and R' is hydrogen or a hydrocarbyl group or a substituted hydrocarbyl group, including —(CH2CH2NH)n- groups. In one embodiment, the friction modifier may be the condensation product of a C8 to C24 fatty acid with a polyalkylene polyamine, for example, the product of isostearic acid with tetraethylenepentamine. The condensation products of carboxylic acids and polyalkyleneamines (xiii) may be imidazolines or amides. The lubricating compositions of this invention may contain a minor amount of a zinc salt of a carboxylic acid. These zinc salts may be acidic, neutral or basic (overbased). These salts may be prepared from the reaction of a zinc containing reagent with a carboxylic acid or salt thereof. A useful method of preparation of these salts is to react zinc oxide with a carboxylic acid. Useful carboxylic acids are those described hereinabove. Preferred carboxylic acids are those of the formula RCOOH where R is an aliphatic or alicyclic hydrocarbon radical. Especially preferred are those wherein R is a fatty group, e.g., stearyl, oleyl, linoleyl, palmityl, etc. More preferred are the zinc salts wherein zinc is present in a stoichiometric excess over the amount needed to prepare a neutral salt. Salts wherein the zinc is present from about 1.1 to about 1.8 times the stoichiometric, especially from 1.3 to 1.6 times the stoichiometric amount of zinc are preferred. These zinc carboxylates are known in the art and are described in U.S. Pat. No. 3,367,869, which is hereby incorporated by reference. Metal salts may also include calcium salts. Examples may include overbased calcium salts.

In one embodiment, the friction modifier may be the condensation product of the above-described amine with a hydroxy acid or hydroxy thioacid or reactive equivalent thereof. In the instance where X is O, the amide may be a derivative of a hydroxy acid which can be represented by the formula R3COOH. In the hydroxy acid (or hydroxy thioacid, as the case may be) R3 may be a hydroxyalkyl group of from 1 to about 6 carbon atoms or a group formed by the condensation of such hydroxyalkyl group, through the hydroxyl group thereof, with an acylating agent (which may include a sulfur-containing acylating agent). That is, the —OH group on R3 may be itself potentially reactive and may condense with additional acidic materials or their reactive equivalents to form, e.g., esters. Thus, the hydroxy acid may be condensed, for instance, with one or more additional molecules of acid such as glycolic acid. An example of a suitable hydroxy acid is glycolic acid, that is, hydroxyacetic acid, HO—CH2-COOH. Glycolic acid may be commercially available, either in substantially neat form or as a 70% solution in water. When R3 contains more than 1 carbon atom, the hydroxy group may be on the 1 carbon (alpha) or on another carbon in the chain (e.g., beta). The carbon chain itself may be linear, branched or cyclic.

In yet another embodiment, the friction modifier may comprise a tertiary amine represented by the formula $$R^1R^2NR^3$$

wherein R1 and R2 are each independently an alkyl group of at least about 6 carbon atoms (e.g., from about 8 to 20 carbon atoms, or from about 10 to about 18, or from about 12 to about 16 carbon atoms) and R3 is a polyhydroxyl-containing alkyl group or a polyhydroxyl-containing alkoxyalkyl group. In one embodiment, the amine may comprise a product of di-cocoalkyl amine or a homologous amine. Di-cocoalkyl amine (or di-cocoamine) is a secondary amine in which two of the R groups in the above formula are predominantly C12 groups derived from coconut oil. In one embodiment, R3 may be a polyol-containing alkyl group (that is, a group containing 2 or more hydroxy groups) or a group containing one or more hydroxy groups and one or more amine groups. For instance, R3 may be —CH2-CHOH—CH2OH or a homologue thereof, containing, for example, from about 3 to about 8 carbon atoms, or from about 3 to about 6 carbon atoms, or from about 3 to about 4 carbon atoms, and 2, 3, 4 or more hydroxy groups (normally no more than one hydroxy group per carbon atom). A typical resulting product may thus be represented by the formula:

R1R2N—CH2-CHOH—CH2OH or homologues thereof, where R1 and R2 may be, as described above, independently alkyl groups of from about 8 to about 20 carbon atoms. Such products may be obtained by the reaction of a dialkyl amine with an epoxide or halogenated hydroxy (e.g., chlorohydroxy, bromohydroxy and/or iodohydroxy) compound. In particular, reaction of a secondary amine with glycidol (2,3-epoxy-1-propanol) or "chloroglycerine" (that is, 3-chloropropane-1,2-diol) may be effective under conditions as described above. Such materials based on the reaction of dicocoamine with one or more moles of glycidol or chloroglycerine may be useful in providing friction-modifying performance. If reaction is with multiple moles of glycidol or chloroglycerine, or other epoxyalkanols or chlorodiols, a dimeric or oligomeric ether-containing group, that is, a hydroxyl-substituted alkoxyalkyl group, may result.

In another embodiment, the friction modifier may comprise one or more of the following condensation products: isostearic acid/trishydroxymethylamino methane ("THAM") (2:1 mole ratio); isostearic acid/2-amino-2-ethyl-1,3-propanediol (2:1 mole ratio); octadecyl succinic anhydride/ethanol amine/isostearic acid (1:1:1 mole ratio); or any of the foregoing materials combined with propylene oxide, for example, in a 1:1 mole ratio. In certain embodiments one or two of the components of the condensation product may contain branched chains.

In each type of condensation product, the carboxylic acids or equivalents may be as shown in the specific examples, or be a similar carboxylic acid derived from fatty acids from natural plant and animal oils or synthetically produced. They are, generally, in the about 8 to about 30 carbon atom range and are substantially linear in character. Alternatively, they may contain from about 10 to about 24 carbon atoms, or from about 12 to about 22 carbon atoms, or from about 16 to 20 carbon atoms. The carboxylic acids or equivalents may be linear or branched. Examples may include stearic acid, palmitic acid, oleic acid, tall oil acids, acids derived from the oxidation of hydrocarbons, substituted succinic acids, ether-acids derived from the addition of acrylates or methacrylates to alcohols, and the like. (The reaction products of the ether-acids may contain the requisite hydrocarbyl groups provided that the groups exhibit substantially hydrocarbon character despite the presence of the ether functionality, as described above in the definition of "hydrocarbyl.") Mixtures of acids can also be used, e.g., isostearic acid and octadecyl succinic acid or octadecyl succinic anhydride, such mixtures being useful when reacted with an aminoalcohol such as ethanolamine.

The aminoalcohol may be a molecule that contains both amine functionality and alcohol functionality. The amine functionality may be in the form of a nitrogen atom containing at least one replaceable hydrogen, that is, a primary or secondary amine. Examples of amino alcohols that may be used may include tris-hydroxymethylaminomethane, 2-amino-2-ethyl-1,3-propanediol, and ethanol amine. Other amino alcohols that may be used may include 3-amino-1-propanol, 2-amino-1-propanol, 1-amino-2-propanol, 2-amino-2-methyl-1-propanol, 4-amino-1-butanol, 5-amino-1-pentanol, 2-amino-1-pentanol, 2-amino-1,2-propanediol, 2-amino-1,3-propanediol, 2-amino-2-methyl-1,3-propanediol, N-(2-hydroxyethyl)ethylenediamine, N,N-bis(2-hydroxyethyl)ethylenediamine, 1,3-diamino-2-hydroxypropane, N—N'-bis-(2-hydroxyethyl)ethylenediamine, and 1-aminopropyl-3-diisopropanol amine. Mixtures of two or more of the foregoing amino alcohols may be used.

The two hydrocarbyl groups present in the friction modifier may originate from the hydrocarbyl portion of the acid reactant. In that case it is generally desirable that 2 moles of acid be reacted with 1 mole of the aminoalcohol, each of the two moles thereby providing one long chain hydrocarbyl group. This ratio may generally vary from about 1.2:1 to about 3:1, or from about 1.6:1 to about 2.5:1, or from about 1.9:1 to about 2.1:1. It is recognized that in any reaction product there may be a mixture of products, and reacting in any of the above ratios may lead to some 1:1 adduct, 2:1 adduct, 3:1 adduct, and so on, in statistical or other ratios depending in part on the relative amounts of the starting materials. The fact that the product may include a portion of the 1:1 adduct does not remove such a product from the scope of the present invention, provided that at least a portion of the product contains the required two hydrocarbyl groups. If two different species of acid are used, the ratios can be about 1:1:1, and so on, provided that the ratio of moles of all such acids to the moles of all the aminoalcohols will normally be about 2:1. Alternatively, if the aminoalcohol itself is the source of one long chain hydrocarbyl group, then a ratio of about 1:1 may be appropriate to provide the two hydrocarbyl groups per molecule.

In one embodiment, the friction modifier of the present invention can be present in an amount from about 0.01 to about 10 percent by weight, or about 0.2 to about 5 percent by weight of the lubricant composition.

Optional Performance Material

The composition optionally further includes at least one additional performance additive. The additional performance additives include antioxidants, detergents, corrosion inhibitors, anti-wear agents or mixtures thereof.

Antioxidants (that is, oxidation inhibitors), including hindered phenolic antioxidants such as 2,6,-di-t-butylphenol, and hindered phenolic esters such as the type represented by the following formula:

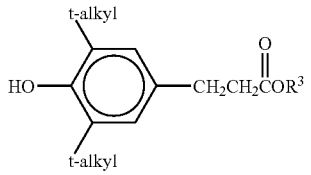

and in a specific embodiment,

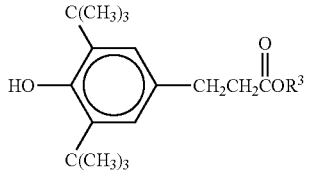

wherein $R^3$ is a straight chain or branched chain alkyl group containing 2 to 10 carbon atoms, in one embodiment 2 to 4, and in another embodiment 4 carbon atoms. In one embodiment, $R^3$ is an n-butyl group. In another embodiment $R^3$ can be 8 carbons, as found in Irganox L-135™ from Ciba. The preparation of these antioxidants can be found in U.S. Pat. No. 6,559,105.

Further antioxidants can include secondary aromatic amine antioxidants such as dialkyl (e.g., dinonyl) diphenylamine, sulfurized phenolic antioxidants, oil-soluble copper compounds, phosphorus-containing antioxidants, molybdenum compounds such as the Mo dithiocarbamates, organic sulfides, disulfides, and polysulfides (such as sulfurized Diels Alder adduct of butadiene and butyl acrylate). An extensive list of antioxidants is found in U.S. Pat. No. 6,251,840.

The EP/antiwear agent used in connection with the present invention can be typically in the form of a zinc dialkyldithiophosphate. In one embodiment, at least 50% of the alkyl groups (derived from the alcohol) in the dialkyldithiophosphate are secondary groups, that is, from secondary alcohols. In another embodiment, at least 50% of the alkyl groups are derived from isopropyl alcohol.

The lubricant composition may also contain one or more corrosion inhibitors. The role of the corrosion inhibitor in this invention is to preferentially adsorb onto metal surfaces to provide protective film, or to neutralize corrosive acids. Examples of these include, but are not limited to polyether derived from an ethylene oxide-propylene oxide copolymer, ethoxylates, alkenyl succinic half ester acids, zinc dithiophosphates, metal phenolates, basic metal sulfonates, fatty acids and amines, triazole and dimercaptothiadiazole and derivatives thereof as described.

The composition can also contain one or more detergents, which are normally salts, and specifically overbased salts. Overbased salts, or overbased materials, are single phase, homogeneous Newtonian systems characterized by a metal content in excess of that which would be present according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (such as mineral oil, naphtha, toluene, xylene) for said acidic organic material, a stoichiometric excess of a metal base, and a promoter.

The acidic organic compounds useful in making the overbased compositions include carboxylic acids, sulfonic acids, phosphorus-containing acids, phenols or mixtures thereof. The acidic organic compounds are carboxylic acids or sulfonic acids with sulfonic or thiosulfonic groups (such as hydrocarbyl-substituted benzenesulfonic acids), and hydrocarbyl-substituted salicylic acids. Another type of compound useful in making the overbased composition is salixarates. A description of the salixarates useful for of the present invention can be found in publication WO 04/04850.

The metal compounds useful in making the overbased salts are generally any Group 1 or Group 2 metal compounds (CAS version of the Periodic Table of the Elements). The Group 1 metals of the metal compound include Group 1a alkali metals (e.g., sodium, potassium, lithium) as well as Group 1b metals such as copper. The Group 1 metals are commonly sodium, potassium, lithium and copper. The Group 2 metals of the metal base include the Group 2a alkaline earth metals (e.g., magnesium, calcium, strontium, barium) as well as the Group 2b metals such as zinc or cadmium. Typical Group 2 metals are magnesium, calcium, barium, or zinc, preferably magnesium or calcium, more commonly calcium.

Examples of the overbased detergent of the present invention include, but are not limited to calcium sulfonates, calcium phenates, calcium salicylates, calcium salixarates and mixtures thereof.

Sulfur compounds may include such material as monosulfides, disulfides, poly-sulfides, sulfurized hydrocarbons, sulfurized olefins, sulfurized fats, sulfurized vegetable oils or any co-sulfurized combination thereof.

The above optional materials may be present in the invention either individually or in mixtures thereof.

INDUSTRIAL APPLICATION

The lubricating composition of the invention is suitable for lubricants in a variety of mechanical devices, including automobiles, trucks, and other equipment such as a manual transmission, an automatic transmission, an automated manual transmission, a continuously variable transmission, a dual clutch transmission, a farm tractor transmission, a transaxle, a heavy duty power-shift transmission, and wet brakes) as well as final drive axles gearing systems and gears such as an automotive gear and a farm tractor gear.

In one embodiment of the invention provides a method for lubricating a gear, comprising supplying thereto a lubricant comprising the lubricating composition as described herein. The use of the lubricating composition in a gear may impart one or more properties including but not limited to seal and composite material compatibility, acceptable friction performance and durability, acceptable anti-shudder performance, acceptable oxidation resistance and acceptable gear protection.

It is known that some of the materials described above may interact in the final formulation, so that the components of the final formulation may be different from those that are initially added. The products formed thereby, including the products formed upon employing the composition of the present invention in its intended use, may not be susceptible of easy description.

Nevertheless, all such modifications and reaction products are included within the scope of the present invention; the present invention encompasses the composition prepared by admixing the components described above.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

EXAMPLES

The invention will be further illustrated by the following examples, which set forth particularly advantageous embodiments. While the Examples are provided to illustrate the present invention, they are not intended to limit it.

The following formulations found in Table 1 are prepared in an oil of lubricating viscosity, where the amounts of the additive components are in percent by weight on an oil free basis.

The lubricants are evaluated in the FZG Scuffing Test, FZG Tractor Gear Wear Weight Loss Test, Tapered Roller Bearing Roller End Scuffing Test and L-37 Test. The results of these tests can be found in Table 2.

The FZG Scuffing Test is used to measure the scuffing load capacity of lubricants used to lubricate hardened steel grams. This test is performed according to ASTM-D5182.

The L-37 test is used to evaluate load carrying wear in an axle under high speed/low torque and low speed/high torque conditions. This test is performed according to ASTM-D6121.

The FZG Tractor Test is used to evaluate the wear loss (in milligrams) of the teeth on a gear. The test is performed according to ASTM-D4998.

The Tapered Roller Bearing Roller End Scuffing Test is used to evaluate the scuffing characteristics or fatigue life on a tapered roller bearing. The test conditions are as follows: tapered roller bearing are lubricated with the test oil under load of 34874 N at a temperature of 90° C.

TABLE 1

(note additives are report in wt. % on an oil free basis

| | Comparative 1 | Comparative 2 | Comparative 3 | Example 1 (invention) | Comparative 4 |
|---|---|---|---|---|---|
| SAE 50 Base Oil | 94.603 | 95.408 | 94.92 | 95.323 | 92.419 |
| Succinimide dispersant | | 2.0 | | 2.0 | 0.99 |
| Boron containing succinimide dispersant | | 0.335 | | 0.335 | |
| Sulfur containing succinimide dispersant | | 0.29 | | | |
| Polybutenylsuccinic ester dispersant | 0.29 | | | | |
| Sulfur and nitrogen containing succinimide disp. | | | | 0.255 | |
| 300 TBN Ca sulfonate detergent | 0.61 | 0.115 | | 0.115 | |
| 82 TBN Ca sulfonate detergent | 0.635 | | | | |
| Ca phenate detergent | 0.64 | | | | |
| 400 TBN Mg sulfonate detergent | | | 1.93 | | 0.37 |
| 400 TBN Mg sulfonate detergent treated with Boron | | | | | 0.71 |
| Aromatic Zn dithiophosphate | 2.52 | | | | |
| Primary Alkyl dithiophosphate | | | 0.9 | | |
| Sulfurized olefin | | | | | 3.5 |
| Amine salt of phosphoric acid esters | | | | | 1.32 |
| Dibutyl hydrogen phosphite | | 0.05 | | 0.05 | |
| Phosphoric acid | | 0.04 | | 0.04 | |
| Triaryl thiophosphate | | 0.14 | | 0.14 | |
| Triaryl phosphite | | | | | 0.271 |
| Substituted thiadiazole | | | | 0.1 | 0.15 |
| Alkyl diphenylamine | | 0.392 | | 0.392 | |
| Substituted hydrocarbyl sulfide | | 1 | | 0.95 | |
| Ethoxylated alkyl amine | | 0.2 | | | |
| Glycerol mono-oleate | | | | | 0.25 |
| Alkenyl phosphite | | | 0.75 | 0.2 | |
| Alkyl borate ester | | | | 0.1 | |
| Alkenyl ester sulfide | | | 1 | | |
| Alkenyl amide | | | 0.25 | | |
| Tolyltriazole | | 0.03 | | | |
| Alkyl 3-sulfolanyl ether | 0.46 | | 0.25 | | |
| Alkyl phenyl ether | 0.11 | | | | |
| Alkenyl succinic anhydride | 0.1 | | | | |
| Acrylate copolymer | 0.032 | | | | 0.02 |
| Polydimethylsiloxane | 5 ppm | 5 ppm | 20 ppm | 5 ppm | 18 ppm |

TABLE 2

| | Comparative 1 | Comparative 2 | Comparative 3 | Example 1 (invention) | Comparative |
|---|---|---|---|---|---|
| FZG Scuffing (A20/8.3/90) | 10 Stage Pass | 12 Stage Pass | 10 Stage Pass | 12 Stage Pass | 12 Stage Pass |
| FZG Scuffing (A10/16.6/90) | 7 Stage Pass | 7 Stage Pass | N/A | 12 Stage Pass 11 Stage Pass | 12 Stage Pass |
| FZG Tractor Gear Wear mg weight loss | 24 | 26 | 35 | 11 | 60 |
| L-37 | Catastrophic gear failure-all teeth broken or chipped | Fail-heavy wear and scoring | Fail | Pass | Pass |
| Tapered Roller Bearing Roller End Scuffing | Bad scuffing | Bad scuffing | N/A | No scuffing | No scuffing |

Note:
Comparative 1-3 are commercially available ATF and Tractors lubricants
Note:
Comparative 4 is a commercially available GL-5 gear oil The results of Table 2 clearly show that the present invention (Example 1) provides surprising better wear characteristics compared to the commercially available Comparatives 1-3 and as good or better than the gear oil of Comparative 4, in spite of the low level of EP agent in present invention. It is well known in the art that EP agents, for example, found in gear oils (Comparative 4) cause seal damage.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What we claim:

1. A lubricant composition comprising:

(a) an oil of lubricating viscosity present at more than 90 percent by weight;

(b) one or more succinimide dispersants comprising a combination of a succinimide dispersant, a boron containing succinimide dispersant, and a sulfur and nitrogen containing succinimide dispersant, present from 0.5 to 3 percent by weight;

(c) one or more phosphorus compounds present from 0.1 to 1.5 percent by weight;

(d) one or more dimercaptothiodiazoles (e) one or more calcium sulfonate overbased detergents;

(f) one or more antioxidants comprising an alkyl diphenyl amine; and (g) one or more friction modifiers;

wherein the amount by weight of the dispersant is greater than the amount by weights of the phosphorus compounds and all sulfur compounds be present.

2. The lubricant composition of claim 1, wherein the composition may further comprise amide/ester dispersants, amine dispersants, Mannich dispersants, ester dispersants, or mixtures thereof.

3. The lubricant composition of claim 1, wherein the phosphorus containing compound comprises a combination of a dibutyl hydrogen phosphate, a phosphoric acid, and an alkenyl phosphate, and optionally further comprising a triaryl thiophosphate.

4. The lubricant composition of claim 1, wherein component (d) comprises 2,5-dimercapto-1,3,4-thiadiazole or a derivative of 2,5-dimercapto-1,3,4-thiadiazole.

5. The lubricant composition of claim 1, wherein the friction modifier comprises sulfurized olefins, borated alkyl epoxides, dialkyl phosphites, glycerol monooleate, pentaerythritol monooleate, amine salts of partial esters of phosphoric acids, zinc salts of fatty acids or mixtures thereof.

6. The lubricant composition of claim 1, further comprising an antioxidant, detergent, corrosion inhibitors, anti-wear agents or mixtures thereof.

7. A method of lubricating final drive axle gearing system comprising:

(a) supplying to said gears a composition comprising:

(i) an oil of lubricating viscosity present at more than 90 percent by weight;

(ii) one or more succinimide dispersants comprising a combination of a succinimide dispersant, a boron containing succinimide dispersant, and a sulfur and nitrogen containing succinimide dispersant, present from 0.5 to 3 percent by weight;

(iii) one or more phosphorus compounds present from 0.1 to 1.5 percent by weight;

(iv) one or more calcium sulfonate overbased detergents;

(v) one or more antioxidants comprising an alkyl diphenyl amine; and (vi) one or more friction modifiers;

wherein the amount by weight of the dispersant is greater than the amount by weight of the phosphorus compounds and all sulfur compounds present.

8. The method of claim 7, wherein the composition may further comprise amide/ester dispersants, amine dispersants, Mannich dispersants, ester dispersants, or mixtures thereof.

9. The method of claim 7, wherein the phosphorus containing compound comprises a combination of a dibutyl hydrogen phosphate, a phosphoric acid, and an alkenyl phosphate, and optionally further comprising a triaryl thiophosphate.

10. The method of claim 7, further comprising 2,5-dimercapto-1,3,4-thiadiazole or a derivative of 2,5-dimercapto-1,3,4-thiadiazole.

11. The method of claim 7, wherein the friction modifier comprises sulfiuzied olefins, borated alkyl epoxides, dialkyl phosphites, glycerol monooleate, pentaerythritol monooleate, amine salts of partial esters of phosphoric acids, zinc salts of fatty acids or mixtures thereof.

12. The method of claim 7, further comprising an antioxidant, detergent, corrosion inhibitors, anti-wear agents or mixtures thereof.

13. The composition of claim 1, wherein the composition comprises a sulfurized olefin friction modifier.

14. The method of claim 7, wherein the composition comprises a sulfurized olefin friction modifier.

* * * * *